US008439809B2

(12) United States Patent
Machado et al.

(10) Patent No.: US 8,439,809 B2
(45) Date of Patent: May 14, 2013

(54) TRAINING DUMMY ASSEMBLY FOR DOING STAND-UP DRILLS AND GROUND DRILLS

(76) Inventors: Jean Jacques Machado, Woodland Hills, CA (US); Joseph Zimmerman, Sherman Oaks, CA (US)

( * ) Notice: Subject to any disclaimer, the term of this patent is extended or adjusted under 35 U.S.C. 154(b) by 63 days.

(21) Appl. No.: 12/931,388

(22) Filed: Jan. 31, 2011

(65) Prior Publication Data

US 2011/0281695 A1 Nov. 17, 2011

Related U.S. Application Data

(63) Continuation-in-part of application No. 12/658,595, filed on Feb. 4, 2010.

(51) Int. Cl.
*A63B 21/00* (2006.01)

(52) U.S. Cl.
USPC ..... 482/83; 482/90

(58) Field of Classification Search ..... 482/83–90
See application file for complete search history.

(56) References Cited

U.S. PATENT DOCUMENTS

| | | | | |
|---|---|---|---|---|
| 5,674,157 | A * | 10/1997 | Wilkinson | 482/83 |
| 5,971,398 | A * | 10/1999 | Broussard et al. | 273/408 |
| 6,155,960 | A * | 12/2000 | Roberts et al. | 482/83 |
| 7,998,035 | B2 * | 8/2011 | Chen | 482/83 |

* cited by examiner

*Primary Examiner* — Jerome w Donnelly
(74) *Attorney, Agent, or Firm* — W. Edward Johansen

(57) ABSTRACT

A training dummy assembly includes a base, a column, a tensioning mechanism, a dummy. The base rests on the ground. The column is pivotally coupled to the base. The tensioning mechanism resiliently couples the base to the column. The dummy has a shape of a torso with head and is formed out of foam with an outer latex skin. The torso of the dummy is mechanically coupled to the column.

2 Claims, 14 Drawing Sheets

TRAINING DUMMY ASSEMBLY FOR DOING STAND-UP DRILLS AND GROUND DRILLS

This is a continuation-in-part of an application filed Feb. 4, 2010 under Ser. No. 12/658,595.

BACKGROUND OF THE INVENTION

1. Field of the Invention

This invention relates generally to a training dummy assembly used in practicing mixed martial arts including Jiu-Jitsu and more particularly to a training dummy for use in not only stand-up drills, but also ground drills. The training dummy assembly utilizes a door and/or doorframe for support.

2. Description of the Prior Art

U.S. Patent Application No. 20100267526 teaches an exercise device which includes a frame having at least first and second vertical members for connecting to opposite vertical sides of a door jamb of a door opening. At least one exercise equipment is supported at least partially by the frame. The exercise device is supported by a door rotatably supported in the doorframe. A portion of either a heavy bag or a speed bag includes a three-dimensional likeness of one or more of a likeness of a human head, torso and body.

Exercise devices for home use are well known in the art. However, such exercise devices can be very cumbersome and can take up large surface areas of the home. Exercise devices for the home have been developed that are compact or fold so as to be stored away when not in use so as not to be cumbersome or take up large areas of the home. Such devices are particularly useful for small homes and apartments. However, such devices are usually flimsy and not supported by a strong base. This is particularly true where the exercise equipment is used for bodybuilding, boxing or martial arts and is subject to heavy and forceful use by a user.

U.S. Pat. No. 6,464,621 teaches a punching aid which includes a base, a column and a pad. The column is provided above the base. The pad is attached onto the column. A flexible rubber pillar has a first end and includes a securing mechanism for securing the flexible rubber pillar between the base and the column to provide flexibility to the column relative to the base. The securing mechanism includes a first coupler provided on the first end of the flexible rubber pillar. A second coupler is provided on the base and includes a locking mechanism for locking the second coupler and the first coupler together.

U.S. Pat. No. 6,139,328 teaches a grappling dummy which is useful as a mock opponent for exercise or practice for athletes training for competitive martial art or wrestling purposes, as well as for practicing self-defense moves. The dummy is given a life size stature of five foot ten inches (178 cm), but a relatively diminutive weight of about forty pounds (18 kg). By giving the grappling dummy such a relatively diminutive weight, it happens to just "feel" right to the user who is practicing or exercising with the dummy. To preserve strength and toughness but conserve on weight, the dummy is produced substantially from soft materials including paper (as newspaper and computer paper, in some uses it is shredded, in others not), the plastic film of waste grocery sacks, burlap (in some uses in sack format, in others plain cloth), garden hose, braided nylon rope, poly strapping, cellophane tape, and duct tape. The sum total of hard elements can be limited to just eight pieces of pine 2.times.2's (eg., 5 cm on a side), and used just in the upper and lower arms and legs of the dummy. The dummy is entirely held together by lashing or knotting of the burlap or rope or poly strapping, or by either forms of the tape. The joints are "stiff" in the sense that a force must be applied sufficient to overcome their stiffness, but after the force falls off the joints "freeze" in place. The grappling dummy is useful for exercise or practice for athletes training for competitive martial art or wrestling purposes, as well as for practicing self-defense moves. The dummy has a "skin" of duct tape, the outermost layer of which is wound around the form of the dummy as in a spiral "mummy" like wrap. The dummy is "topless" and "barefoot" and is dressed only in hospital pants for modesty's sake as a form of exercise clothing. In use the grappling dummy serves as a mock opponent for a user to practice his exercise routine. The user is addressing the dummy in a side clinch stance. The legs of the dummy provide sufficient resistance to prop up not only the dummy but also some fractional amount of the weight of the user, who is shown leaning onto the dummy. The user can practice a choke on the dummy from the guard position. This position is also a test position after production, to check if the neck is secured sufficiently against pulling out. In fact, the other extremities of the dummy 10 are comparably tested for strength against pulling out, and this includes the upper arm from the shoulder, the lower arm from the upper arm, the hand from the lower arm, the upper leg from the torso, the lower leg from the upper leg, the foot from the lower leg, and so on. A torso for the grappling dummy includes two burlap sacks stuffed firmly with shredded paper, and wrapped in cellophane tape and duct tape on top of that. The torso is much like a conventional punching bag found in boxing gyms. That is, it has a fabric liner filled tightly with a soft stuffing.

In the art of self defense, such as karate, judo and jiu jitsu, the classical approach has been to practice self defense techniques with a training partner, using either no body contact at all or some degree of contact, such as full contact, but with a range of padding accessories worn by both partners in order to protect both partners against injury. If no partner is available, then one usually practices on either a stuffed hanging canvass bag or a stuffed dummy.

Many of the above training dummy assemblies optimizes self defense practice for stand-up position drills in that an individual can practice actually hitting the dummy as hard as possible in all the desired body locations so as to instantly "inflict" what would be a mortal or disabling blow to an actual person. However, none of the above training dummy assemblies optimizes self defense practice for ground position drills in which an individual may train with a stuffed dummy weighing one hundred pounds of dead weight but he is not practicing his ground position skills in a realistic manner. What is also needed is a grappling dummy assembly that allows the individual to practice his ground position skills in a realistic manner.

The inventors hereby incorporate all of the above referenced patents into this specification.

SUMMARY OF THE INVENTION

The present invention is generally directed to a training dummy assembly which includes a base, a column and a dummy. The base rests on the ground. The column mechanically couples the dummy to the base. The dummy has a shape of a torso with head and is formed out of foam with an outer latex skin.

In a first aspect of the present invention the column is pivotally coupled to the base. An adjustable bungi cord resiliently couples the column to the base.

In a second aspect of the present invention the torso has a pair of shoulders and a pair of arms. Each arm has a weighted hand and is pivotally coupled to one of the shoulders of the torso. Each arm is free floating and weighted so that when the dummy is either upright or horizontal the weighted hands will cause the arms to continually swing downward for various arm-lock techniques.

In a third aspect of the present invention each arm includes an upper limb and a lower limb, a hinge which forms an elbow and includes a mechanism coupled to the hinge. The mechanism has a knob so that a user can either tighten or loosen the hinge in order to adjust tightness of the hinge for practicing various arm-lock techniques.

In a fourth aspect of the present invention the arms are attached to the shoulders of the torso by a tense bungi cord that is situated along an inner tube stretched from shoulder to shoulder to hooks each of which is fastened to one of the upper limbs.

In a fifth aspect of the present invention the training dummy assembly can be used in the practice of mixed martial arts including jiu-jitsu for use in not only stand-up drive, but also ground drills.

In a sixth aspect of the present invention the training dummy assembly saves space, time and money with two workout bags in one.

In a seventh aspect of the present invention the use of the training dummy assembly eliminates the user's need to stumble or adjust into place a heavy dummy on top of the user to practice his ground-fighting skills and to strictly focus on his technique with this mobile yet stationary opponent as opposed to trying to balance a 100 lbs of dead mannequin weight on top of him.

In an eighth aspect of the present invention the training dummy assembly allows a user who studies Jiu Jitsu, Boxing, Karate or Mixed Martial Arts to simply adjust either the adjustable bungi cord or the locking (leveling) position pin and go from Punching and Kicking to Chokes, Armbars, Kimuras, Triangles and Guillotines.

In a ninth aspect of the present invention the training dummy assembly can be utilized for doing either Stand-Up Position Drills or Ground Position Drills using either an Adjustable Level Positioner or an adjustable bungi cord thereby providing additional realistic mobility.

In a tenth aspect of the present invention the height of the training dummy assembly can be adjusted from 5'6" to 6'4".

In an eleventh aspect of the present invention the torso of the training dummy assembly can be turned around for taking-the-back situations.

In a twelfth aspect of the present invention the training dummy assembly has a controllable tilt and resistant ability so it can lean forward and down for real stand-up & resistant Guillotine chokes or Knees to the body.

In a thirteenth aspect of the present invention the training dummy assembly the base may be filled with either water or sand.

In a fourteenth aspect of the present invention the training dummy assembly the base may also be anchored by 45 lbs plate that is disposed in a plate slot.

Other aspects and many of the attendant advantages will be more readily appreciated as the same becomes better understood by reference to the following detailed description and considered in connection with the accompanying drawing in which like reference symbols designate like parts throughout the figures.

The features of the present invention which are believed to be novel are set forth with particularity in the appended claims.

DESCRIPTION OF THE PREFERRED EMBODIMENT

Figure 1:
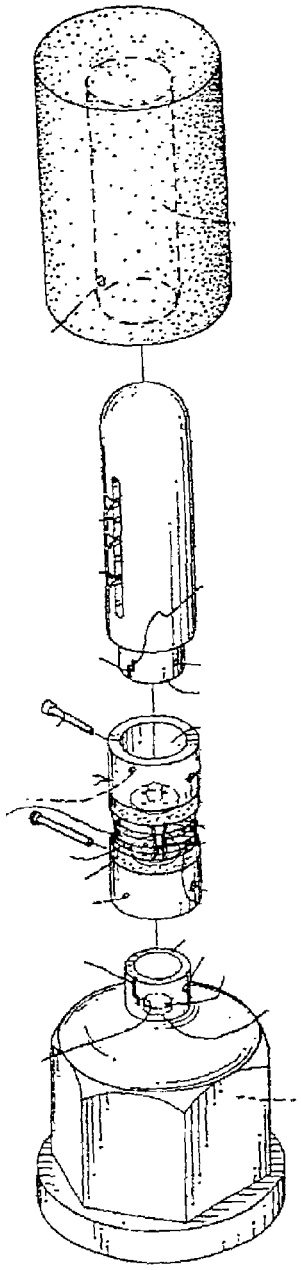
Fig. 1 (Prior Art)
FIG. 1 is a first figure from U.S. Pat. No. 6,464,621.
Figure 2:
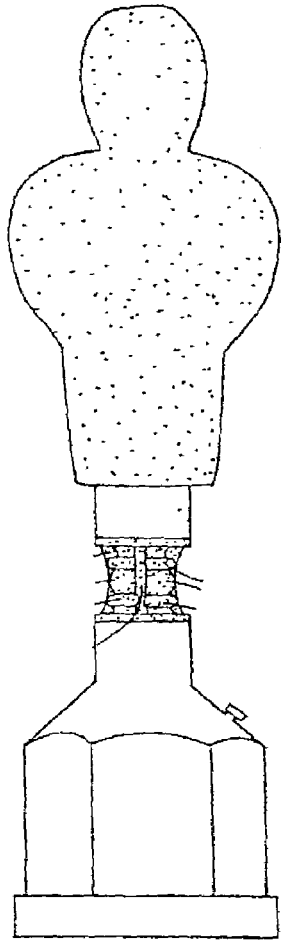
Fig. 2 (Prior Art)
FIG. 2 is a second figure from U.S. Pat. No. 6,464,621.
Figure 3:
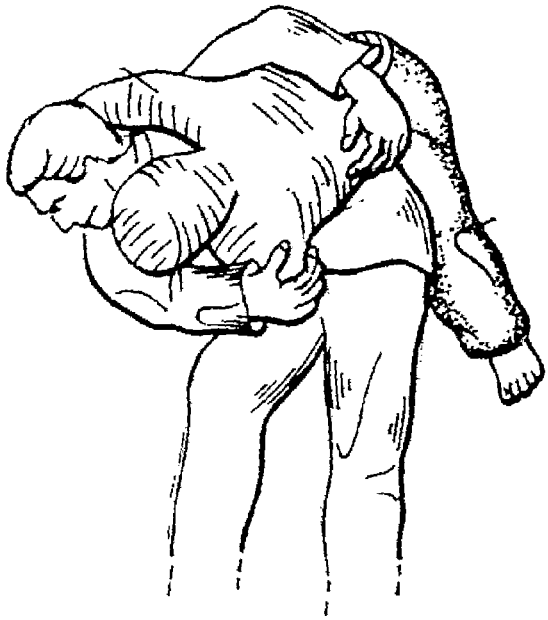
Fig. 3 (Prior Art)
FIG. 3 is a first figure from U.S. Pat. No. 6,139,328.
Figure 4:
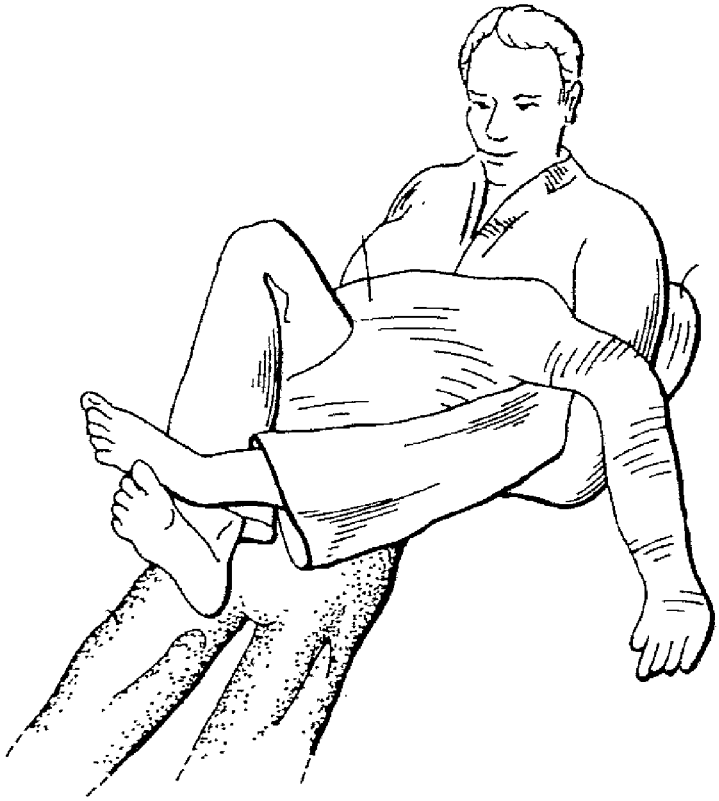
Fig. 4 (Prior Art)
FIG. 4 is a second figure from U.S. Pat. No. 6,139,328.
Figure 5:
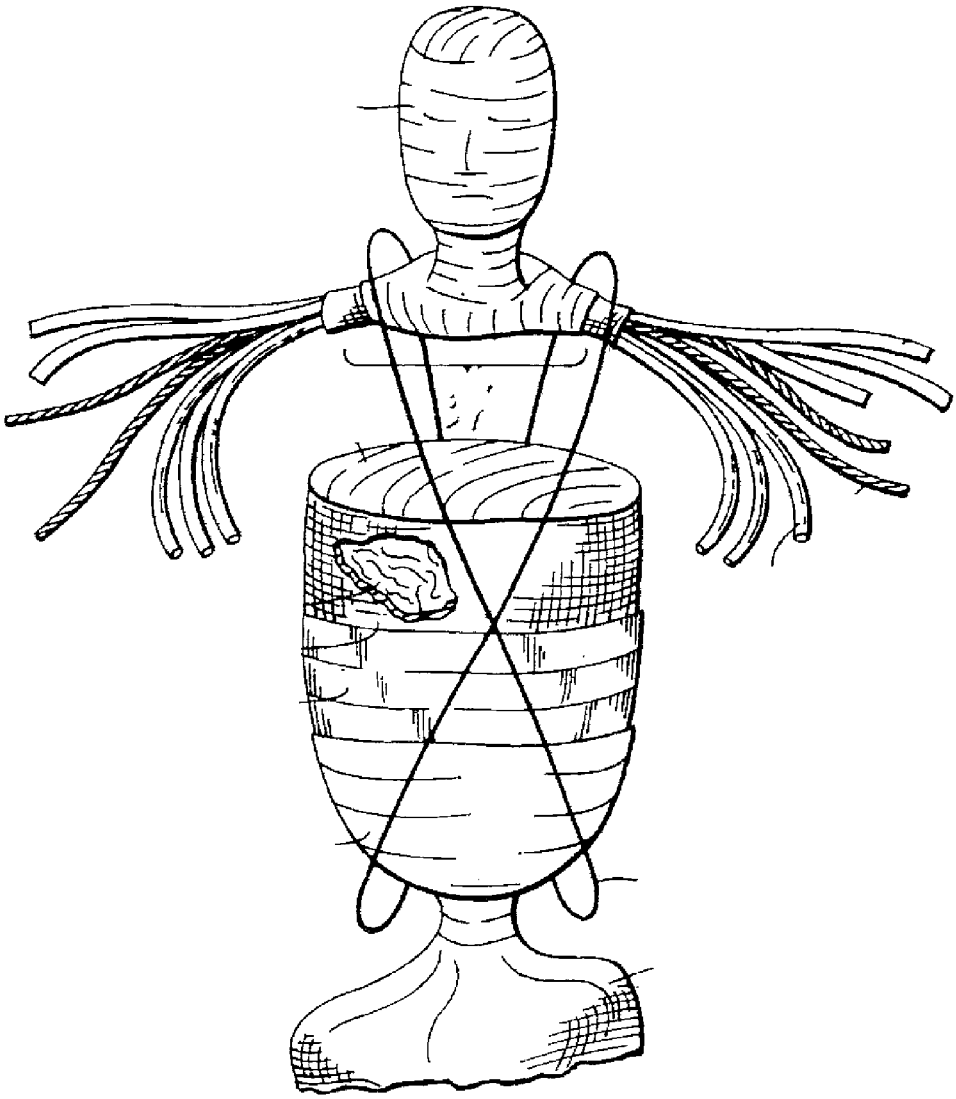
Fig. 5 (Prior Art)
FIG. 5 is a third figure from U.S. Pat. No. 6,139,328.
Figure 6:
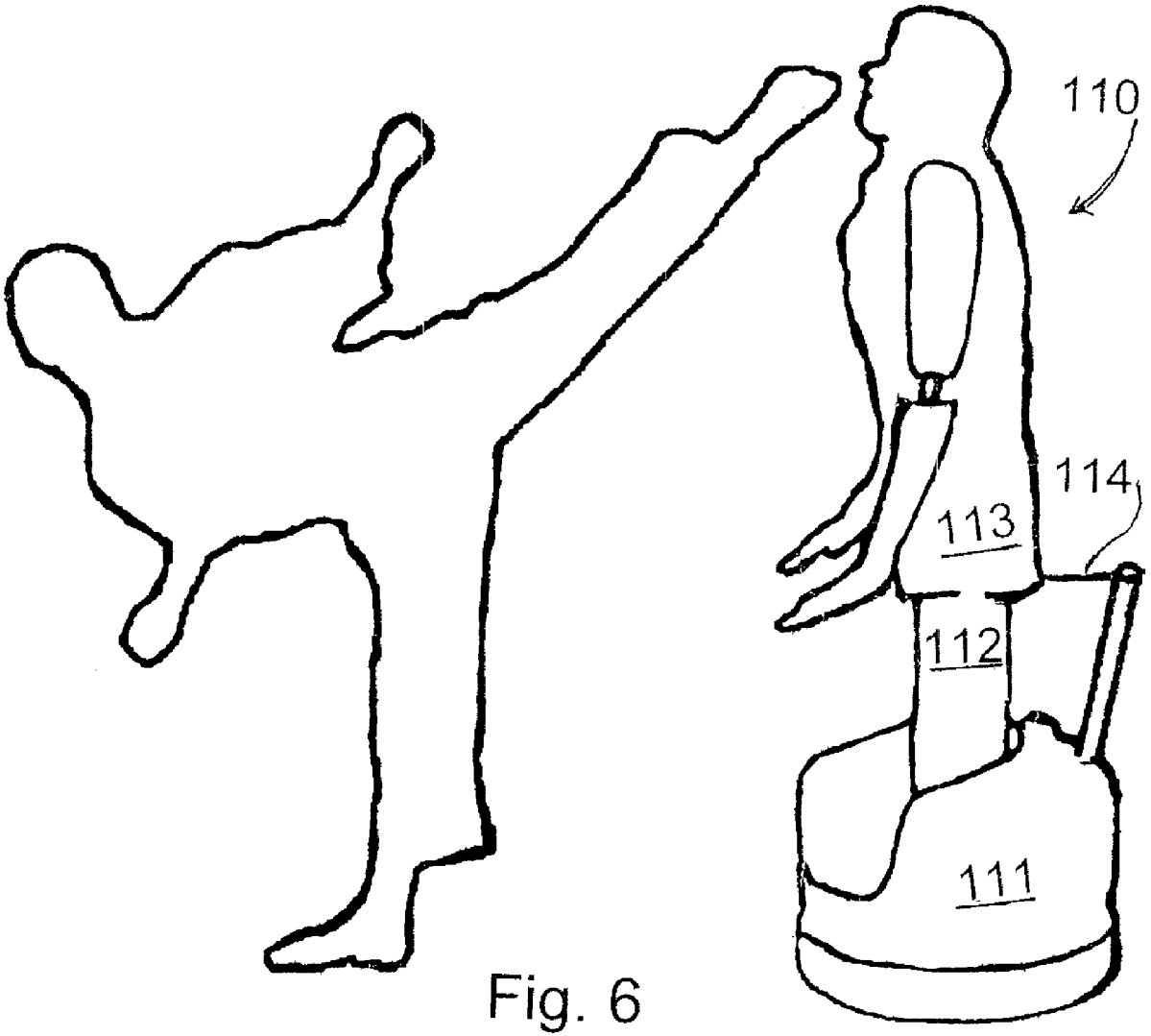
FIG. 6 is schematic silhouette drawing of the training dummy assembly in the stand-up position according to the first embodiment of the present invention.
Figure 7:
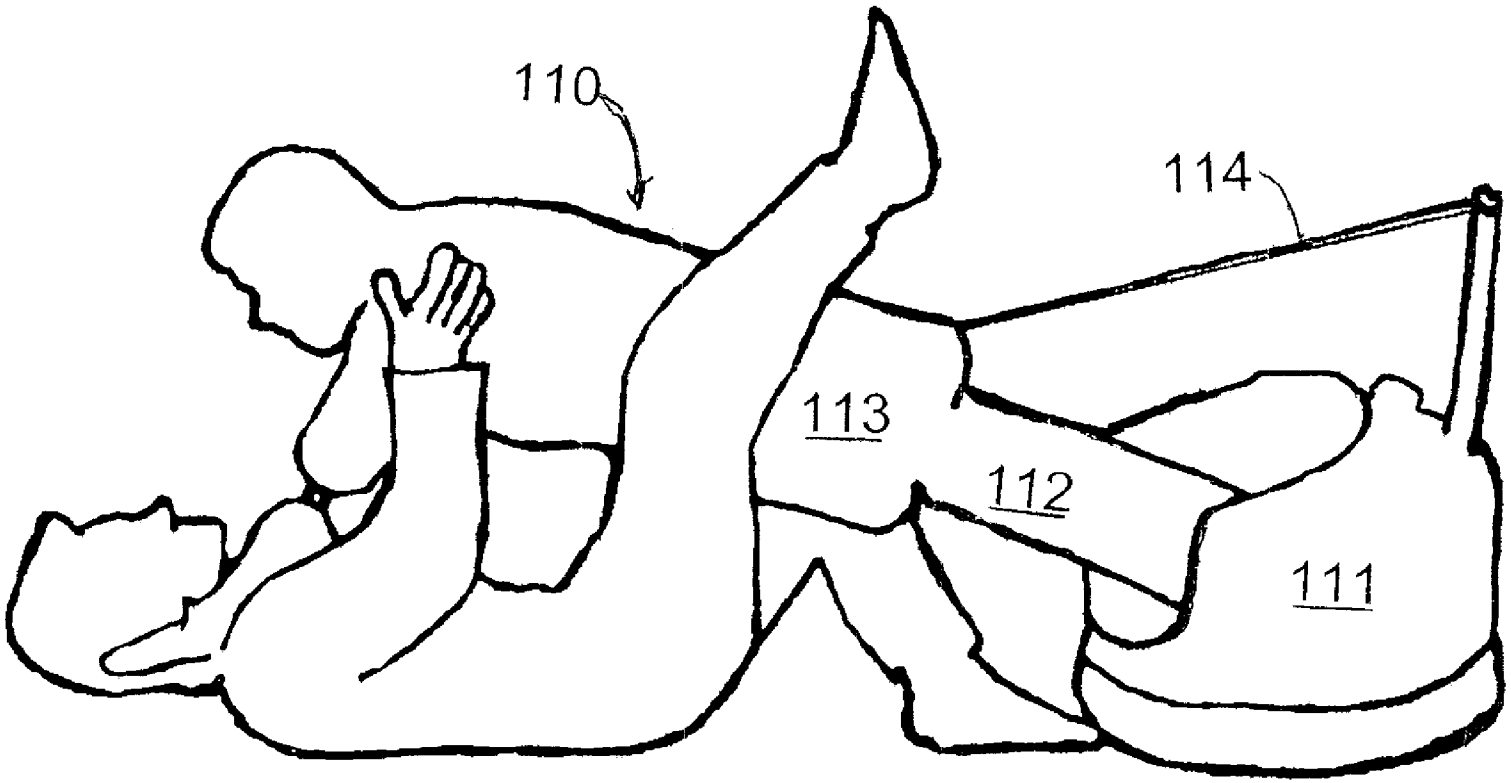
FIG. 7 is schematic silhouette drawing of the training dummy assembly of FIG. 6 in the ground position.

Referring to FIG. 6 in conjunction with FIG. 7 a first training dummy assembly 110 includes a base 111, a column 112, a dummy 113 and a tensioning mechanism 114. The base 111 rests on the ground. The column 112 is pivotally coupled the dummy 113 to the base 111. The tensioning mechanism 114 resiliently couples the dummy 113 to the base 111.

Figure 8:
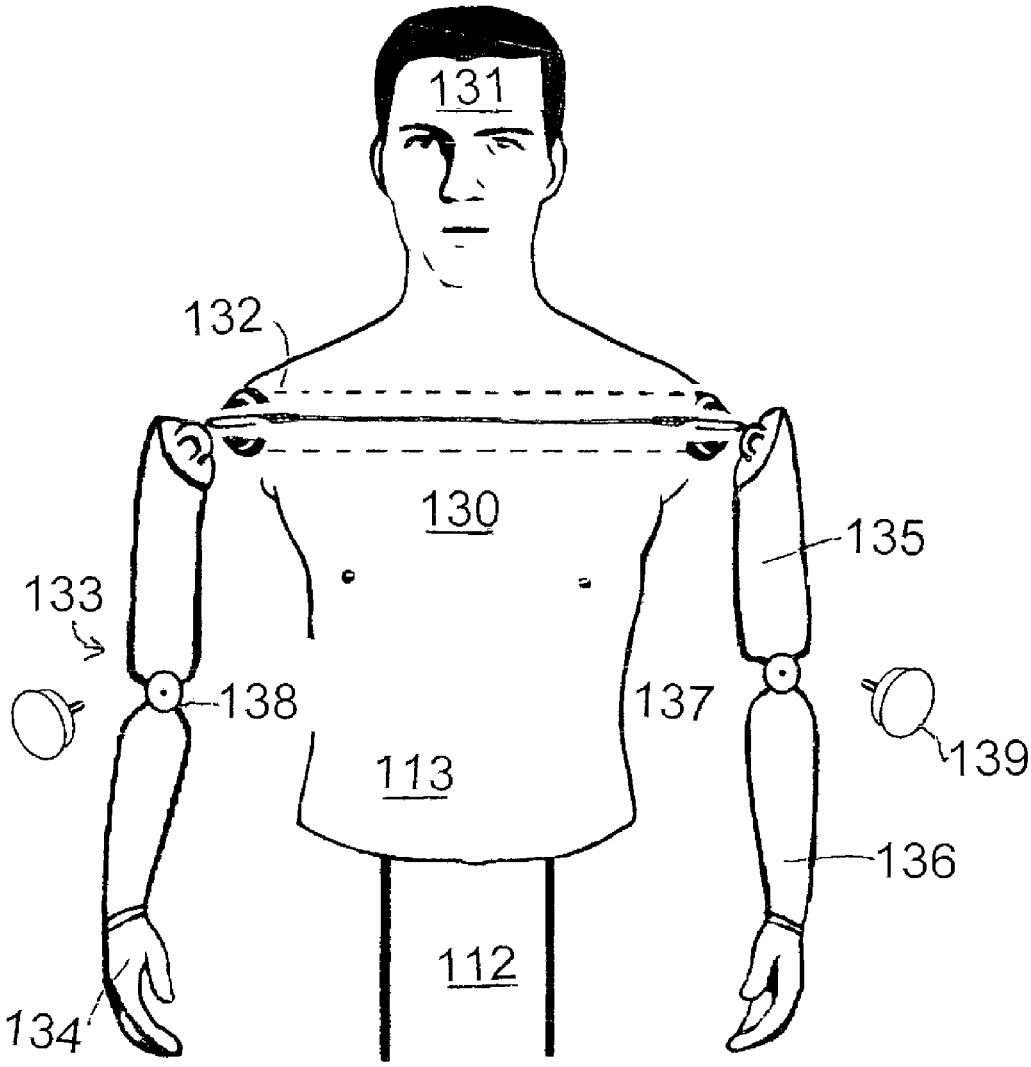
FIG. 8 is a torso with a head, shoulder connection and arms of the training dummy assembly of FIG. 6.

Referring to FIG. 8 the dummy 113 has a shape of a torso 130 with head 131 and is formed out of foam with an outer latex skin. The torso 130 has a pair of shoulders 132 and a pair of arms 133. Each arm 133 has a weighted hand 134 and is pivotally coupled to one of the shoulders 132 of the torso 130. Each arm 133 is free floating and weighted so that when the dummy 113 is either upright or horizontal the weighted hands will cause the arms 133 to continually swing downward for various arm-lock techniques. Each arm 133 includes an upper limb 135 and a lower limb 136, a hinge 137 which forms an elbow and includes a mechanism 138 coupled to the hinge 137. The mechanism 137 has a knob 139 so that a user can either tighten or loosen the hinge 137 in order to adjust tightness of the hinge 137 for practicing various arm-lock techniques.

Figure 9:
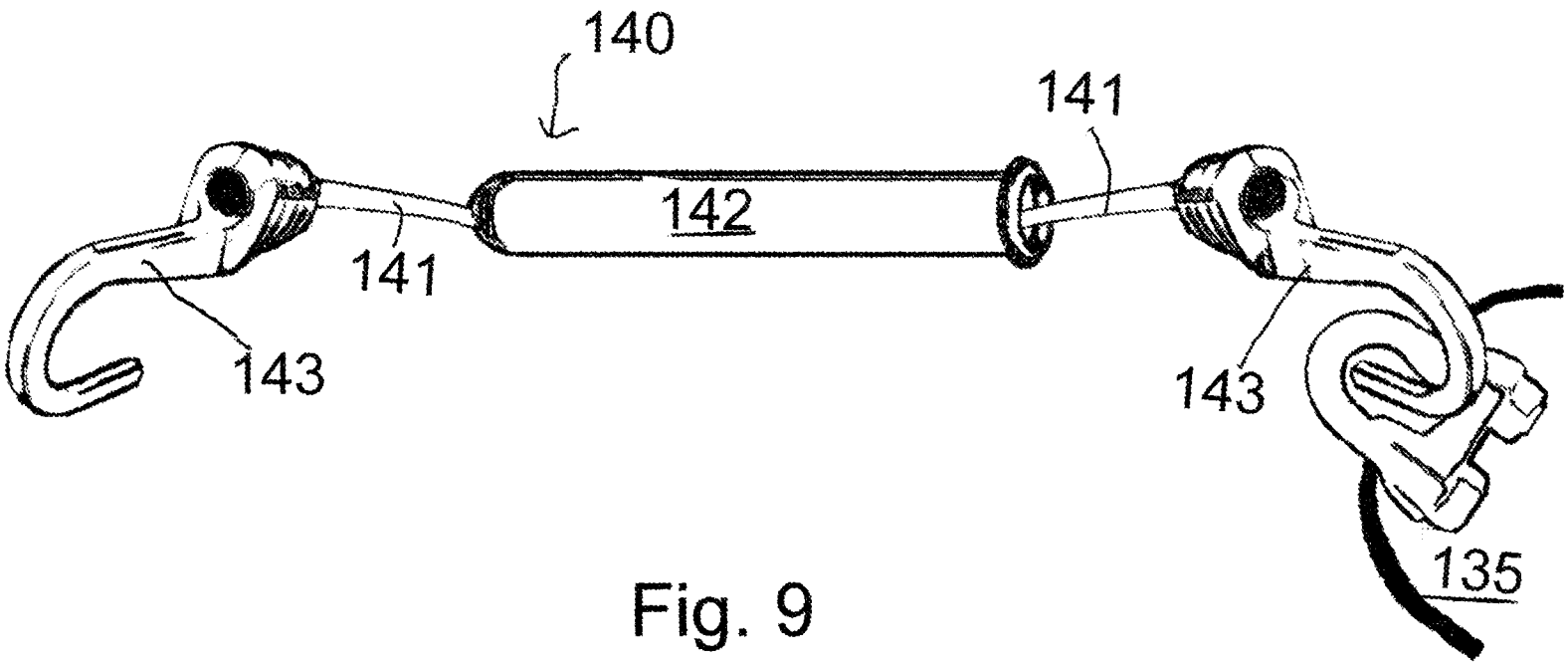
FIG. 9 is a perspective drawing of the shoulder connection of the torso of FIG. 8.

Referring to FIG. 9 in conjunction with FIG. 8 a shoulder mechanism 140 pivotally and resiliently couples the arms 133 to the shoulders 132 of the torso 130. The shoulder mechanism 140 includes a first bungi cord 141, an inner tube 142 and a pair of hooks 143. The first bungi cord 141 is situated along the inner tube 142 and is stretched from shoulder to shoulder to the hooks 143 each of which is fastened to one of the upper limbs 135.

Figure 10:
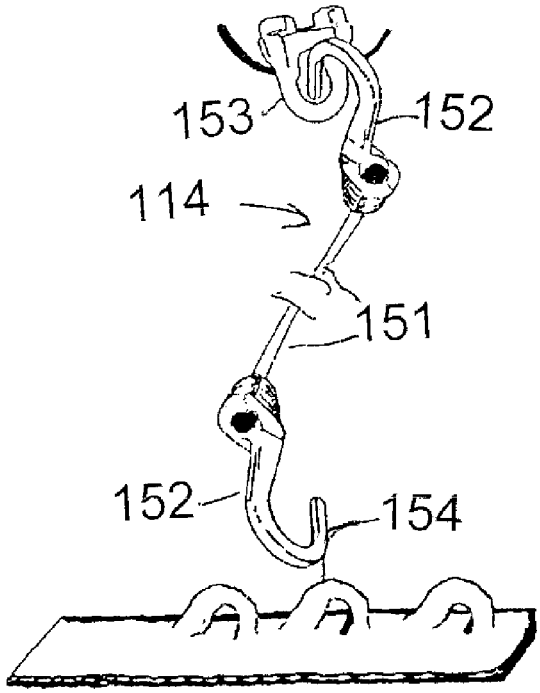
FIG. 10 is a tensioning mechanism of the training dummy assembly of FIG. 6.

Referring to FIG. 10 in conjunction with FIG. 8 the tensioning mechanism 114 includes a second bungi cord 151, a pair of hooks 152, a first loop mount 153 and a plurality of second loop mounts 154. The first loop mount 153 is mechanically coupled to the torso 130 of the dummy 113. The second loops mounts 154 are mechanically coupled to the base 113.

Figure 11:
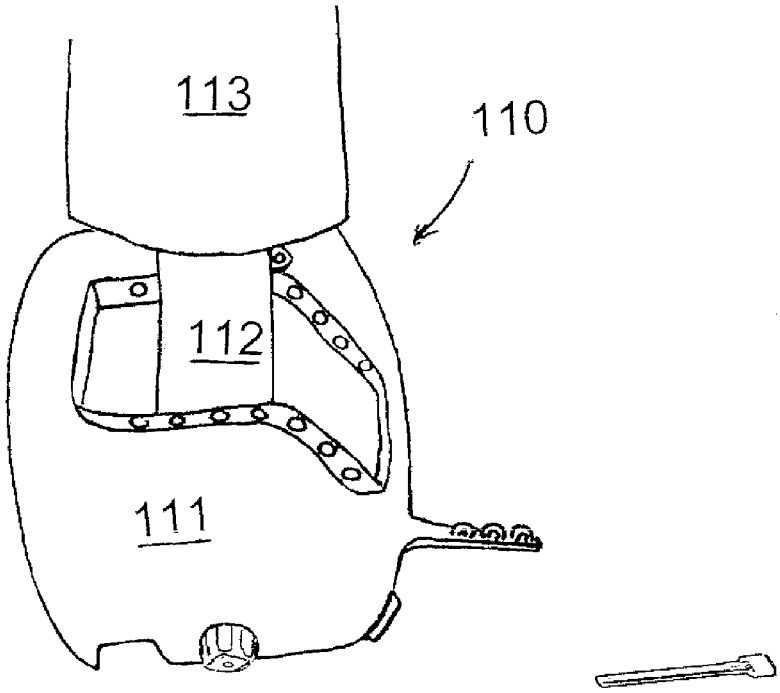
FIG. 11 is a perspective drawing in partial cross-section of a base of the training dummy assembly of FIG. 6.
Figure 12:
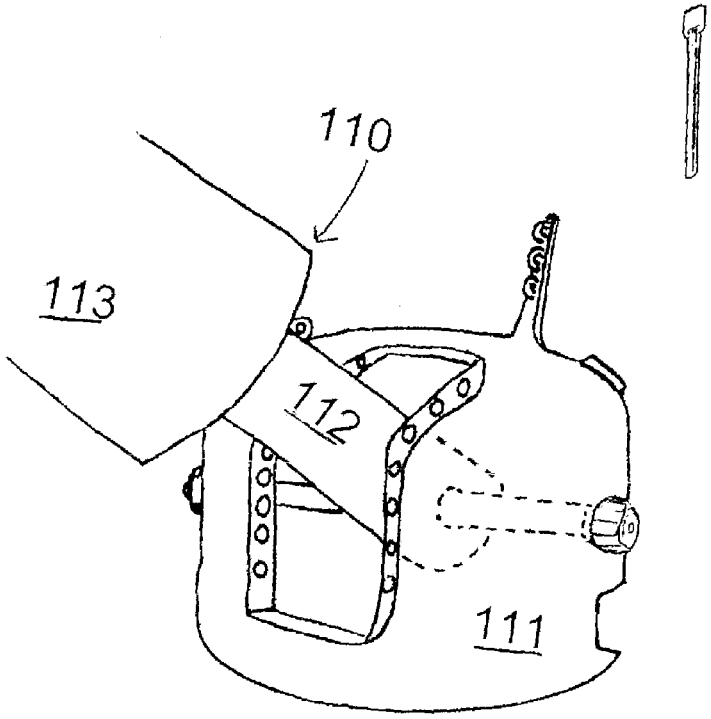
FIG. 12 is a perspective drawing of the base of the training dummy assembly of FIG. 6.

Referring to FIG. 11 in conjunction with FIG. 12 the base 113 may be filled with either water or sand and may also have an optional 45 lbs plate which is inserted into a slot. A lower Main Body Shaft, which is a rectangular tubular section, inserts sideways down into the base 113 via the top opening. Sliding the shaft down will place it at the bottom flooring where a simple twist will position it in place. Inserting the Locking Rod secures the Shaft.

Figure 13:
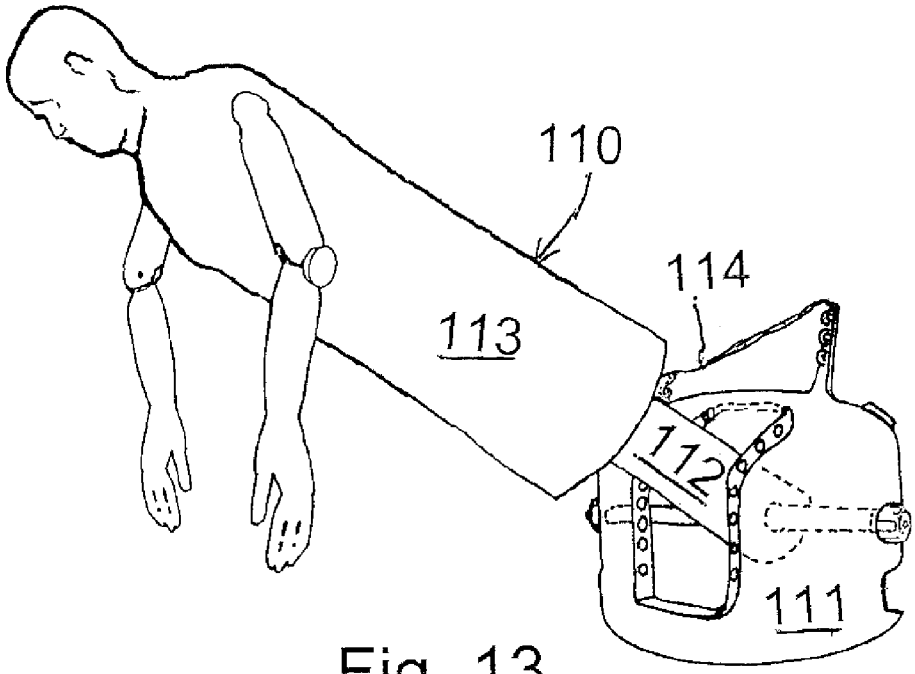
FIG. 13 is a perspective drawing of the training dummy assembly of FIG. 6 in a mid-way position between the stand-up position and the ground position.
Figure 14:
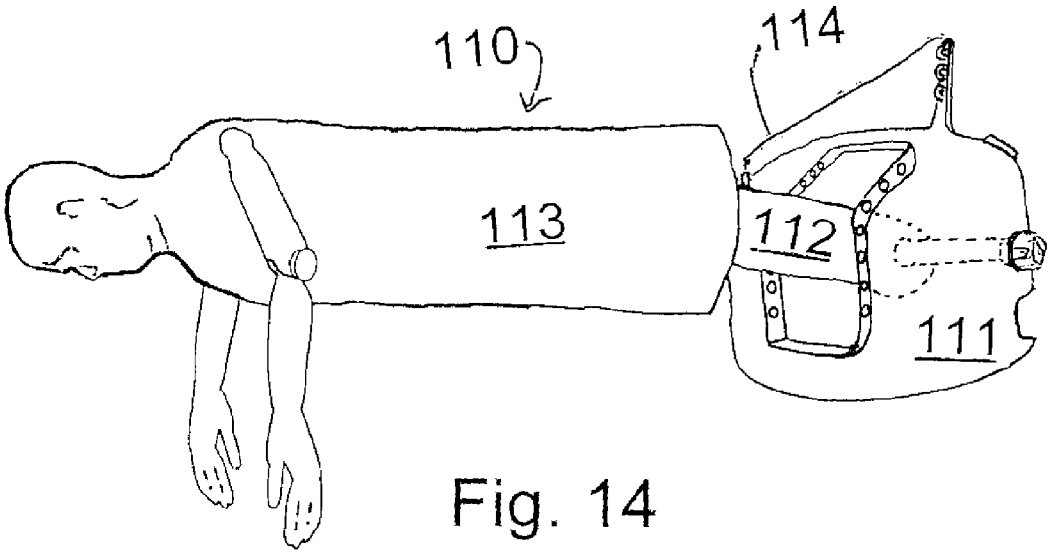
FIG. 14 is a perspective drawing of the training dummy assembly of FIG. 6 in the ground position.

Referring to FIG. 13 in conjunction with FIG. 14 the training dummy assembly 110 can be used in the practice of mixed martial arts including jiu-jitsu for use in not only stand-up drive, but also ground drills. The training dummy assembly saves space, time and money with two workout bags in one. The use of the training dummy assembly eliminates the user's need to stumble or adjust into place a heavy dummy on top of the user to practice his ground-fighting skills and to strictly focus on his technique with this mobile yet stationary opponent as opposed to trying to balance a 100 lbs of dead mannequin weight on top of him. The training dummy assembly allows a user who studies Jiu Jitsu, Boxing, Karate or Mixed Martial Arts to simply adjust the locking (leveling) position pin (and/or the adjustable bungi cord) and go from Punching and Kicking to Chokes, Armbars, Kimuras, Triangles and Guillotines. The training dummy assembly can be utilized for Stand Up or Ground Position Drills with Adjustable Level Position (and/or bungi cord tension). The height of the training dummy assembly can be adjusted from 5'6" to 6'4". The torso of the training dummy assembly can be turned around for taking-the-back situations. The training dummy assembly has a controllable tilt and resistant ability so it can lean forward and down for real stand-up & resistant Guillotine chokes or Knees to the body. The training dummy assembly the base may be filled with either water or sand. The training dummy assembly the base may also be anchored by 45 lbs plate that is disposed in a plate slot.

Alternative embodiments include using a "Spring Mechanism" at the base to tilt the dummy, using a "Handle or Crank Lever" on the side of base with tilt control, an "Electric Motor" with a pulley and pegs inserted into attached Holes along the Support Base to manually adjust the tilt.

Figure 15:
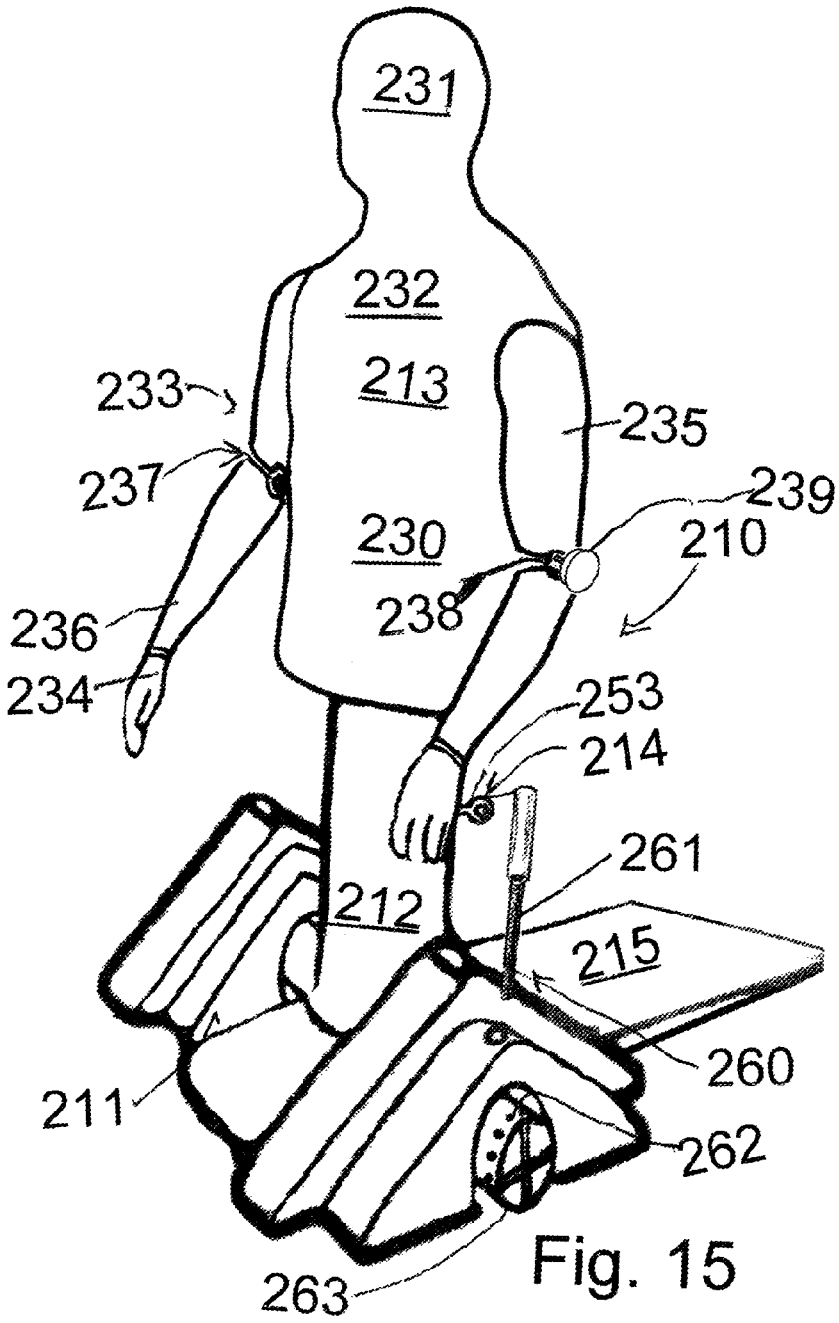
FIG. 15 is a perspective drawing of the training dummy assembly having a torso with a head, shoulder connection and arms, a tensioning mechanism, a base with controllable tilt turning mechanism and a decline rubber door-jam according to the second embodiment of the present invention.
Figure 16:
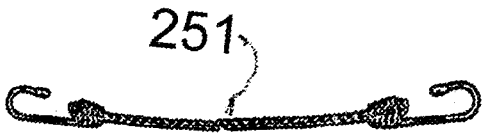
FIG. 16 is a perspective drawing of the decline rubber door-jam of FIG. 15.
Figure 17:
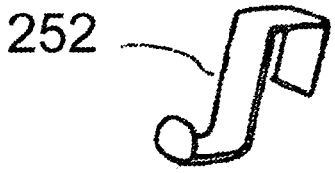
FIG. 17 is a perspective drawing of a door-hook which attaches to the tensioning mechanism of FIG. 15.
Figure 18:
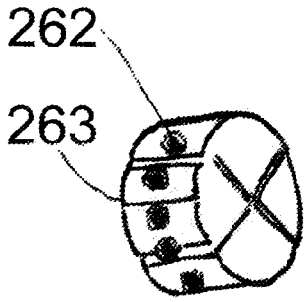
FIG. 18 is a perspective drawing of the controllable tilt mechanism of FIG. 15.

Referring to FIG. 15 in conjunction with FIG. 7, FIG. 16, FIG. 17 and FIG. 18 a second training dummy assembly 210 includes a base 211, a column 212, a dummy 213 and a tensioning mechanism 214. The base 211 rests on the ground and is attached to a decline rubber door-jam 215 which is inserted between a door and the floor in order to anchor the base 211 to ground. The column 212 pivotally couples the dummy 213 to the base 211. The tensioning mechanism 214 resiliently couples the dummy 213 to a door-hook which is attached to the door. The dummy 213 has a shape of a torso 230 with head 231 and is formed out of foam with an outer latex skin. The torso 230 has a pair of shoulders 232 and a pair of arms 233. Each arm 233 has a weighted hand 234 and is pivotally coupled to one of the shoulders 232 of the torso 230. Each arm 233 is free floating and weighted so that when the dummy 213 is either upright or horizontal the weighted hands will cause the arms 233 to continually swing downward for various arm-lock techniques. Each arm 233 includes an upper limb 235 and a lower limb 236, a hinge 237 which forms an elbow and includes a mechanism 238 coupled to the hinge 237. The mechanism 237 has a knob 239 so that a user can either tighten or loosen the hinge 237 in order to adjust tightness of the hinge 237 for practicing various arm-lock techniques. Each shoulder 234 pivotally and resiliently couples one of the arms 233. The tensioning mechanism 214 includes a second bungi cord 251, a hook 252 and a loop mount 253. The loop mount 253 is mechanically coupled to the torso 130 of the dummy 213. The base 211 has a controllable tilt mechanism 260 which include locking pin 261, a plurality of locking pin holes 262 and a controllable tilt turning knob 263.

From the foregoing it can be seen that a training dummy assembly for use in not only stand-up drill, but also ground drills has been described. It should be noted that the sketches are not drawn to scale and that distances of and between the figures are not to be considered significant. Accordingly it is intended that the foregoing disclosure and showing made in the drawing shall be considered only as an illustration of the principle of the present invention.

What is claimed is:

1. A training dummy assembly comprising: a. a base which rests on the ground; b. a column pivotally coupled to said base wherein said column pivots in a range of 0 degrees to approximately 90 degrees and is mechanically stable so that a user of said training dummy assembly is able to practice his ground drills; c. a tensioning mechanism resiliently coupling said base to said column; and d. a dummy having a shape of a torso with head and being formed out of foam with an outer latex skin wherein said torso of said dummy is mechanically coupled to said column wherein said torso has a pair of shoulders and a pair of arms each of which has a weighted hand and each of which is pivotally coupled to one of said shoulders of said torso and wherein said arms are attached to said shoulders of said torso by a tense bungi cord that is situated along an inner tube stretched from shoulder to shoulder to hooks each of which is fastened to one of said upper limbs whereby each of said arms is free floating and weighted so that when said dummy is either upright or horizontal said weighted hands will cause the arms to continually swing downward for various arm-lock techniques.

2. A training dummy assembly for use with a door, said training dummy assembly comprising: a. a base which rests on the ground; b. a column pivotally coupled to said base wherein said column pivots in a range of 0 degrees to approximately 90 degrees and is mechanically stable so that a user of said training dummy assembly is able to practice his ground drills; c. a door-jam coupled to the door; d. a tensioning mechanism resiliently coupling said door-jam to said column; and e. a dummy having a shape of a torso with head and being formed out of foam with an outer latex skin wherein said torso of said dummy is mechanically coupled to said column wherein said torso has a pair of shoulders and a pair of arms each of which has a weighted hand and each of which is pivotally coupled to one of said shoulders of said torso and wherein said arms are attached to said shoulders of said torso by a tense bungi cord that is situated along an inner tube stretched from shoulder to shoulder to hooks each of which is fastened to one of said upper limbs whereby each of said arms is free floating and weighted so that when said dummy is either upright or horizontal said weighted hands will cause the arms to continually swing downward for various arm-lock techniques.

* * * * *